US006754918B1

(12) United States Patent
Lap

(10) Patent No.: US 6,754,918 B1
(45) Date of Patent: Jun. 29, 2004

(54) ANCHORED FLEXURE SYSTEM

(76) Inventor: Li Yick Lap, 46 Lai Yip Street, 1/E, Kwun Tong, Kowloon, Hong Kong (HK)

( * ) Notice: Subject to any disclaimer, the term of this patent is extended or adjusted under 35 U.S.C. 154(b) by 0 days.

(21) Appl. No.: 10/354,703

(22) Filed: Jan. 30, 2003

(51) Int. Cl.[7] ..... A47G 9/08

(52) U.S. Cl. ..... 5/413 R; 5/502; 2/69.5; 2/97; 428/102; 428/188

(58) Field of Search ..... 5/413 R, 413 HM, 5/502, 482; 2/69.5, 97, 93, 272; 428/102, 188

(56) References Cited

U.S. PATENT DOCUMENTS 3,787,906 A * 1/1974 Hunt ..... 5/413 R
3,857,125 A * 12/1974 Hunt ..... 5/413 R
3,988,791 A * 11/1976 Simon ..... 5/413 R
4,115,610 A * 9/1978 Wortman ..... 428/102
4,354,281 A * 10/1982 Satoh ..... 5/413 R

* cited by examiner

*Primary Examiner*—Alexander Grosz
(74) *Attorney, Agent, or Firm*—Collen IP; Donald J. Ranft

(57) ABSTRACT

A design is provided for the construction of an insulating system for use in sleeping bags and other applications in which improved insulation and loft properties are sought. By bending the fibers or netting and attaching an anchor, additional compartments and increased loft are provided. The additional compartments created slow the thermal transfer rate to improve the insulation properties.

15 Claims, 3 Drawing Sheets

PRIOR ART

PRIOR ART

ANCHORED FLEXURE SYSTEM

BACKGROUND OF INVENTION

Sleeping bags generally can be divided into 2 groups: down-filled sleeping bags and synthetic-fiber filled sleeping bags. It is obvious that the difference between them is mostly referring to the different insulating materials. Construction wise, the down and synthetic fiber sleeping bags are made differently, but they do share some similarities.

Synthetic Fiber Construction

The synthetic fiber used in sleeping bags is typically made up of polyester fiber filaments. The filaments are then processed (mixing and heating) in the form of a padding. The thickness of the padding makes synthetic fiber a good thermal protection material to trap air. The air is trapped within the dense confines of the fiber network. Given that the synthetic fiber is not a good heat conductor, the heat (warmth) will stay within the system longer. The combination of the synthetic fibers and the trapped air provides a good insulation system, especially for sleeping bags. There are 2 different types of construction utilized in synthetic sleeping bags: Layer construction and Shingle construction.

Layer construction as depicted in FIG. 1, is just a simple padding of synthetic fiber on other material. This is the simplest way to construct a sleeping bag.

As depicted in FIG. 1 there are 2 layers of synthetic fiber in each of the top and bottom half. In both the top and bottom halves, one layer is stitched to the shell fabric and the other layer is stitched to the lining fabric. This construction is typically referred to as 2-layer quilt construction since there are 2 layers of synthetic fibers covering around the body.

Shingle construction consists of a series of parallel fixed synthetic fibers which overlap as depicted in FIG. 2. Because of the overlapping, sleeping bags made with shingle construction general provide better (higher) loft. FIG. 2 depicts a 2-layer shingle construction. The way to see it is to look at the "Cross section line". As you move the line forward and backward long the length of the bag, at any given point, you will see 2 layers of padding. This may not be as obvious as the 2 layers in layer quilt construction, but it does give the same result in which you will have 2 layers of insulation covering around user's body.

Down Filled Construction

The thermal protection of down is very well established, especially in the apparel business. Due to its exceptional thermal protection and its lightweight, down is also very commonly used in sleeping bags. Other materials characterized by low thermal transfer rates and relatively light weight are also used in lieu of down. FIGS. 3 & 4 depict the two most common constructions concerning down sleeping bags.

The key to the down sleeping bag construction is to fill a series of compartment space with down. FIG. 3 depicts a vertical box construction. Scrim netting (polytricot) is typically used to form compartments. The scrim netting is very similar to synthetic fibers but it is typically significantly lighter and denser in its construction. The netting is usually 100% polyester but other materials can be used. This netting offers no insulating value and its function is nothing more than providing lightweight medium to contain the down in each of the compartments.

The slant box construction depicted in FIG. 4, is very similar to synthetic fiber shingle construction. The differences being the scrim netting in lieu of synthetic fibers and the addition of down in the compartments formed.

BRIEF SUMMARY OF INVENTION

This invention consists of a new method for construction of sleeping bags and the applications in which improved insulation properties are desired. This invention provides a method to improve insulation characteristics by adding additional compartments to show the thermal transfer rate while also increasing loft. This invention can be applied in both the synthetic fiber construction as well as the down filled construction.

DRAWING LEGEND

1—Outer shell

2—Lining shell

3—Synthetic Fibers

4—Stitch point—outer shell

5—Stitch point—lining shell

6—Scrim netting (polytricot)

7—Down (or other insulating material)

8—Anchor

9—Midpoint/anchor stitch point

10—Additional compartments

DESCRIPTION OF THE PREFERRED EMBODIMENT

Traditional insulation system is really just a padding of multiple layers of insulation. The basic method is to simply put one batting cut on top of the other (Layer construction). The more advanced method is in shingle format (Shingle construction) but the feature in both methods is having 2 separate batting cuts overlapping with each other. The difference in the Anchored Flexure System is the layering is not generated by 2 different batting cuts, it is generated by folding a single batting cut.

In the sleeping bag business, people are concerned about how lofty the bag looks because people usually relate loft with warmness. In the traditional construction, the loft is generated by overlapping a series of slanted batting cuts. The loft in the Anchored Flexure System construction is generated by bending the same batting cut. This takes advantage of the natural strength of the fiber against bending to increase the loft.

The second significant feature of the Anchored Flexure System is the creation of additional compartments (10). These additional compartments (10), in the case of a synthetic-filled sleeping bag, function as air-trapping compartments where the warm air is trapped. In the case of a down-filled sleeping bag, the additional compartments (10) are filled with down (7) and air to trap heat. The more compartments in a system, the better down protection coverage where the down surrounds the whole body.

Figure 1:
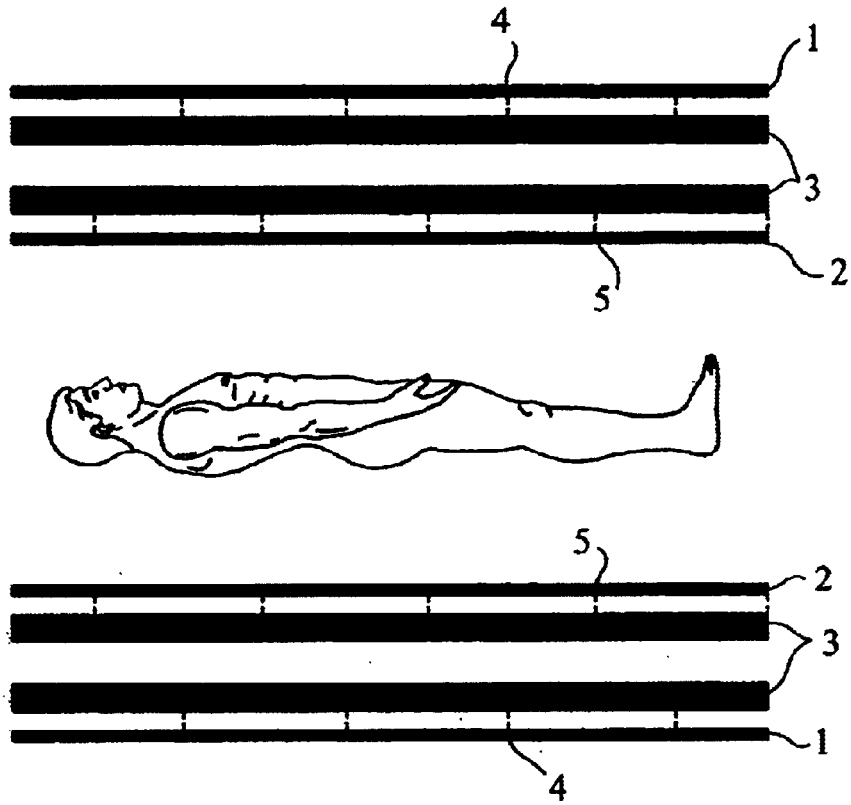
FIGURE 1 PRIOR ART
FIG. 1 is a cross-sectional view of a typical layer constructed sleeping bag (both halves)
Figure 2:
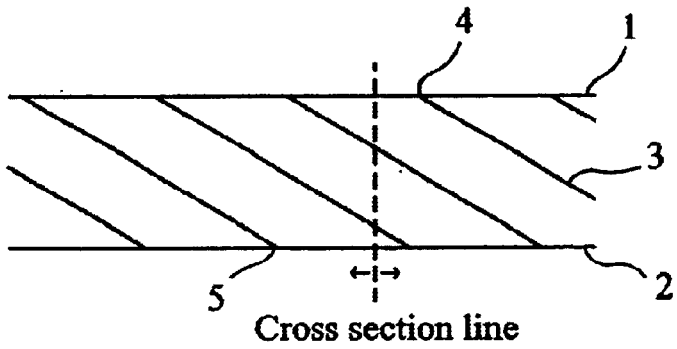
FIG. 2 is a cross-sectional view of a typical shingle constructed sleeping bag (top half)
Figure 3:
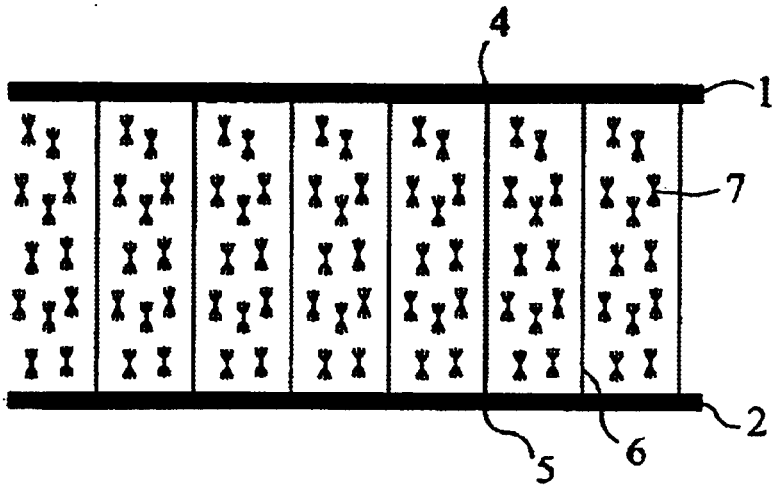
FIGURE 3 PRIOR ART
FIG. 3 is a cross-sectional view of a typical vertical box constructed down-filled sleeping bag (top half)
Figure 4:
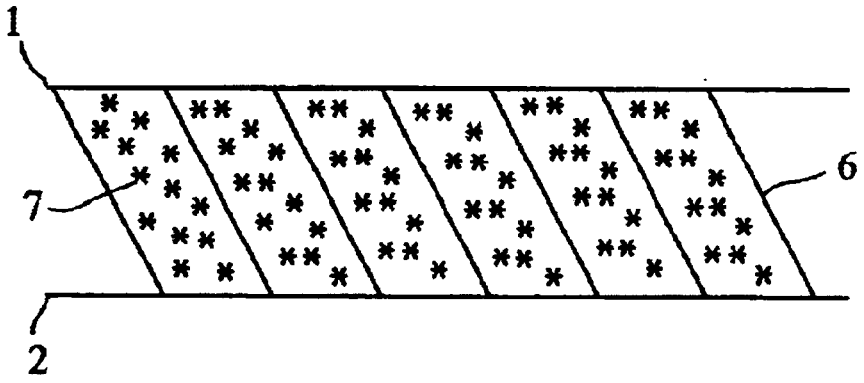
FIG. 4 is a cross-sectional view of a typical slant box constructed down-filled sleeping bag (top half)
Figure 5:
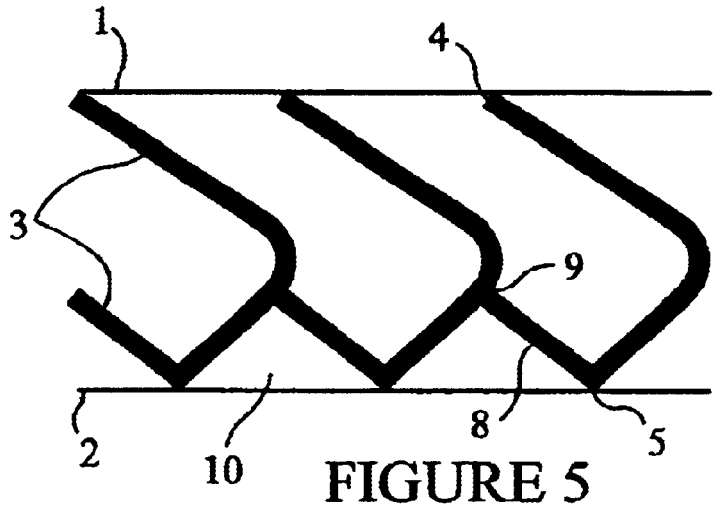
FIG. 5 is a cross-sectional view of an Anchored Flexure System constructed synthetic fiber sleeping bag (top half)

As depicted in FIG. 5, in the Anchored Flexure System, the synthetic fibers (3) are configured so as to be bent at a midpoint (9). One end of the synthetic fiber (3) is stitched (5) to the lining shell (2) and the other end is stitched (4) to the outer shell (1). One end of the anchor (8) is stitched (5) to the inner shell (2) and the other end is stitched to a midpoint (9) of the adjacent synthetic fiber. The midpoint (9) is preferably at a point which is not less than 20% of the length of the synthetic fiber (3). For better insulation properties, the midpoint of each fiber is overlapped by the adjacent fiber in a lateral direction.

Figure 6:
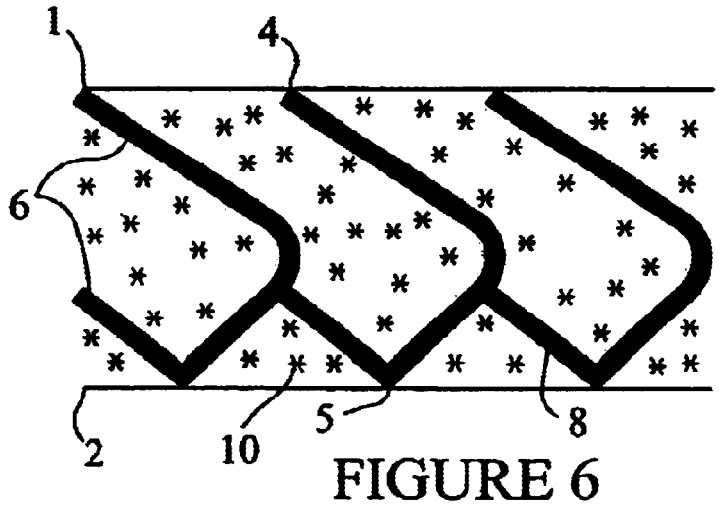
FIG. 6 is a cross-sectional view of an Anchored Flexure System constructed down-filled sleeping bag (top half).

FIG. 6 depicts the Anchored Flexure System utilized in a down-filled sleeping bag. The netting (Polytricot) (6) is configured so as to be bent at a midpoint (9) region or area. One end of the netting (6) is stitched (5) to the lining shell (2) and the other end is stitched (4) to the outer shell (1). The anchor (8) is stitched (5) to the lining shell (2) at one end and to the midpoint (9) of the adjacent netting at the other end. The midpoint (9) is preferably at a point which is not less than 20% of the length of the netting measured from the outer and lining shells. For better insulation properties, midpoint of each netting is overlapped by the adjacent netting in a lateral direction.

The above description is specifically in relation to the use of the Anchor Flexure System for certain types of sleeping bags. The Anchor flexure System can also be applied in many other applications requiring insulation such as clothing, blankets, piping, buildings, housing, structures, etc. In addition, it can also be applied to other sleeping bag configurations utilizing materials other than synthetic fibers and down. This invention is not limited to the specific configurations and methods describe above. For example, other means for attachment may be utilized in lieu of stitching, e.g., adhesives and clamps. As with all insulation systems, it can be used to retain heat or cold temperatures as desired.

What is claimed is:

1. An Anchored Flexure System for providing insulation comprising:

an outer shell an inner liner shell synthetic fibers connected between the inner and outer shells said fibers being bent at a midpoint an anchor connected at said midpoint at its one end and connected at the inner shell at its other end ensuring the fibers remain bent and creating an additional compartment for the retention of heat or cold.

2. An Anchored Flexure System according to claim 1 which is configured to surround an object or living being to retain its temperature.

3. An Anchored Flexure System according to claim 2 which is configured to form a sleeping bag.

4. An Anchored Flexure System according to claim 1 in which the midpoint is not less than 20% of the length of the fibers.

5. An Anchored Flexure System according to claim 1 in which the synthetic fibers are configured to ensure that each synthetic fiber overlaps the adjacent synthetic fiber's midpoint in a lateral direction.

6. An Anchored Flexure System according to claim 1 in which the connecting of the synthetic fibers to the outer and liner shells is via stitching.

7. An Anchored Flexure System according to claim 1 in which the synthetic fibers comprise a fabric.

8. An Anchored Flexure System for providing insulation comprising:

an outer shell, an inner liner shell, netting connected between the inner and outer shells, each said netting being bent at a midpoint, an anchor connected at said midpoint at its one end and connected at the inner shell at its other end ensuring the netting remains bent and creating an additional compartment for the retention of heat or cold.

9. An Anchored Flexure System according to claim 8 which is configured to surround an object or living being to retain its temperature.

10. An Anchored Flexure System according to claim 9 which is configured to form a sleeping bag.

11. An Anchored Flexure System according to claim 8 which the midpoint is not less than 20% of the length of the netting.

12. An Anchored Flexure System according to claim 8 in which the netting is configured to ensure that each netting overlaps the adjacent netting's midpoint.

13. An Anchored Flexure System according to claim 8 in which the connecting of the netting to the outer and liner shells is via stitching.

14. An Anchor Flexure System according to claim 8 in which compartments formed by the netting and anchors contain an insulating material.

15. An Anchor Flexure System according to claim 14 in which the insulating material is down.

* * * * *

UNITED STATES PATENT AND TRADEMARK OFFICE

CERTIFICATE OF CORRECTION

PATENT NO. : 6,754,918 B1
APPLICATION NO. : 10/354703
DATED : June 29, 2004
INVENTOR(S) : Lap It is certified that error appears in the above-identified patent and that said Letters Patent is hereby corrected as shown below:

On the title page item (76),

The address change of the inventor Yick Lap Li from "46 Lai Yip Street, 1/E, Kwun Tong, Kowloon, Hong Kong (HK)" to --Unit A, 3/F, Houtex Industrial Building, 16 Hung To Road, Kwun Tong, Kowloon, Hong Kong--.

Signed and Sealed this

Twenty-first Day of April, 2009

John Doll

JOHN DOLL
*Acting Director of the United States Patent and Trademark Office*